United States Patent [19]

O'Meara

[11] Patent Number: 5,052,589

[45] Date of Patent: Oct. 1, 1991

[54] UNIT DOSE ASSEMBLY

[75] Inventor: John R. O'Meara, Jamesburg, N.J.

[73] Assignee: CP Packaging, Inc., Jamesburg, N.J.

[21] Appl. No.: 476,839

[22] Filed: Feb. 8, 1990

[51] Int. Cl.[5] ..... B67D 5/00

[52] U.S. Cl. ..... 222/83; 222/107; 222/541; 215/257

[58] Field of Search ..... 222/83, 83.5, 107, 153, 222/215, 541, 545, 570; 215/6, 250, 257

[56] References Cited

U.S. PATENT DOCUMENTS

| | | | |
|---|---|---|---|
| 2,771,218 | 11/1956 | Henderson | 222/83 |
| 3,454,196 | 7/1969 | Hazard | 222/541 X |
| 3,922,099 | 11/1975 | Christine et al. | 222/107 X |
| 4,296,786 | 10/1981 | Brignola | 222/83.5 X |
| 4,493,439 | 1/1985 | Ledewitz | 222/107 X |
| 4,681,243 | 7/1987 | Takasugi | 222/83 |
| 4,723,687 | 2/1988 | Kutterer | 222/83 |
| 4,867,326 | 9/1989 | O'Meara | 222/83 X |
| 4,884,703 | 12/1989 | O'Meara | 222/83 X |

FOREIGN PATENT DOCUMENTS

| | | | |
|---|---|---|---|
| 629467 | 3/1959 | Italy | 222/83 |

*Primary Examiner*—Michael S. Huppert
*Assistant Examiner*—Gregory L. Huson
*Attorney, Agent, or Firm*—Eugene E. Renz, Jr.

[57] ABSTRACT

A cap and tube assembly device, including a tube for containing a product, a nozzle having one end mounted to one end of the tube and having a thin wall section puncturable to provide a discharge on the other end and a cap. The nozzle has a smaller axial cross section than the tube. The junction of the tube and the nozzle define an inclined surface of transition to permit flow without cavitation from the tube to the nozzle. The cap has an inside cross section sized to engage the nozzle and an outside cross section less than the inside cross section of the tube. The cap has an axially centered piercing point positioned in a first position spaced from the thin wall and movable to a second position to puncture the thin wall. The piercing point includes a chisel shaped edge for forming a hole in the thin wall without fragmenting the wall. Also provided are ribs positioned in the tube for preventing entry of the cap into the nozzle when a plurality of these assemblies are stacked one on another.

3 Claims, 2 Drawing Sheets

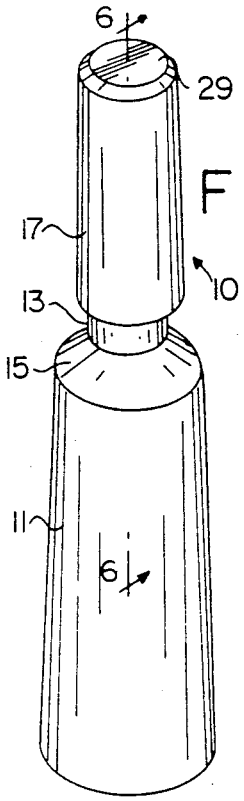
FIG. 1
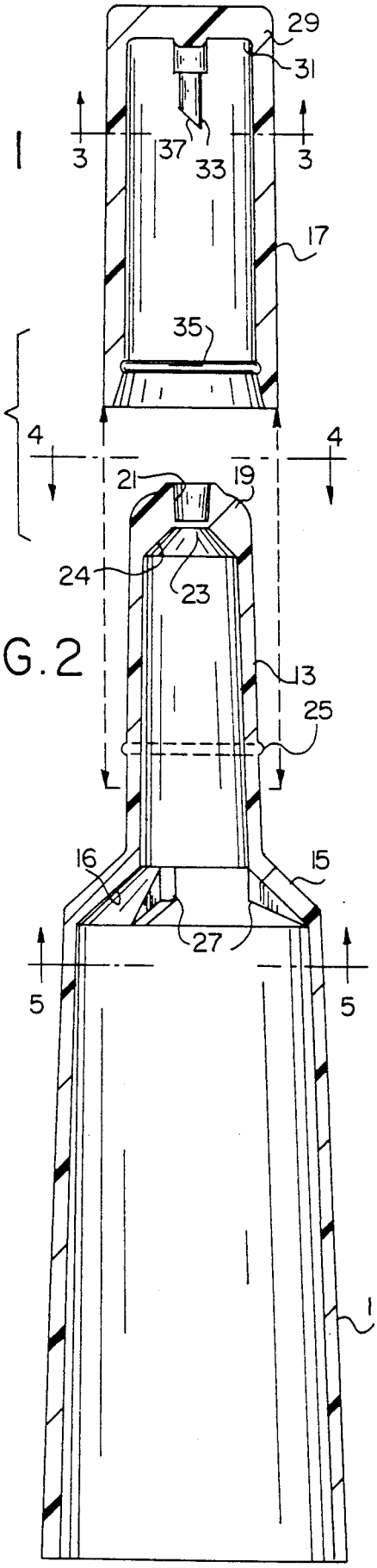
FIG. 2
FIG. 3
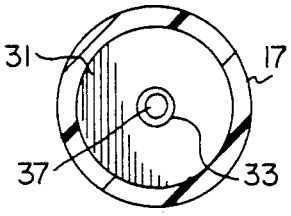
FIG. 4
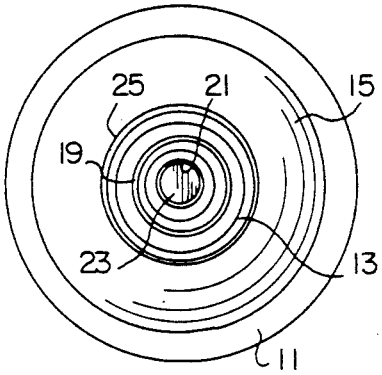
FIG. 5
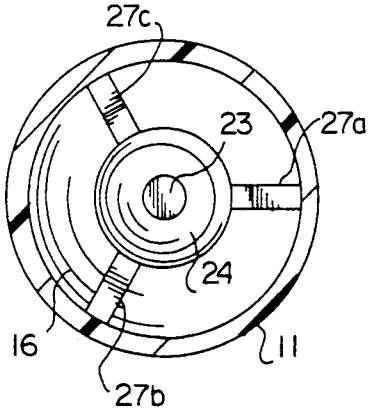
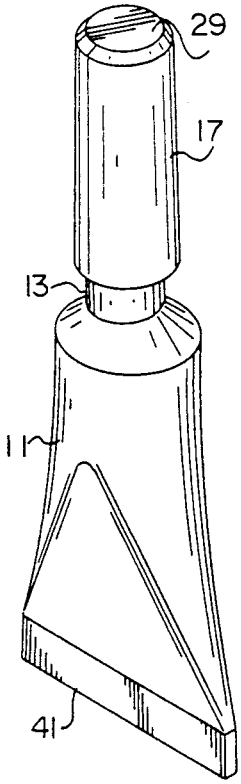
FIG. 10

11
11a
13
13a
15
15a
16
17
17a
19
21
23
23a
24
25
27a
27c
29
31
33
35
37
39

UNIT DOSE ASSEMBLY

FIELD OF THE INVENTION

This invention relates to unit dose assembly devices and more particularly to a cap and tube assembly in which a unit dose is provided in a tube. The tube may contain a single dose of medicine, vitamins, eye drops, or other pharmaceutically related products. The device is particularly suitable for use with sterile medicaments which need to be protected by the container prior to use.

BACKGROUND OF THE INVENTION

Cap and tube assemblies which carry medicines, vitamins, and the like have obtained significant interest in the pharmaceutical industry. Not only is there a concern for resistance to undesirable tampering, such as by a child, there is increasing interest in insuring that the entire dose contained in the container is delivered to the patient and that no parts of the container itself contact the patient.

In my recent patent, U.S. Pat. No. 4,867,326, I have provided an excellent design for a child resistant cap. The design described in my patent is of great value in providing a product wherein there is easy inspection of unit dose sterile medicaments in a cap and tube assembly which is child resistant and suitable for a high reliability pass/fail inspection.

Depending upon the size of the tube, the thickness of the thin wall, and the shape of the piercer, tearing the plastic thin wall causes pieces to break off. These small pieces of plastic are inert, and normally are not harmful. However, particularly when the contents are eye drops, it would be of great advantage if the possibility of small pieces of plastic breaking off could be reduced to the absolute minimum, if not totally eliminated. Accordingly, that is one of the objects of the present invention.

Also, the junction between the tube and the portion of the tube which forms the discharge structure for a cap and tube assembly often times includes a sharp junction, as would necessarily happen if the discharge nozzle was merely joined to the tube using conventional technology. In this case, sometimes when the product is dispensed from the tube, one or two drops are trapped on what becomes a ledge or ring at the junction between the tube and the discharge nozzle. When it is important that the entire dose be received by the user, failure to remove these one or two drops provides a less than complete treatment. Accordingly, it is another object of this invention to provide a design which allows for total evacuation of the tube.

In order to increase the efficiency of cap and tube assemblies during the filling step, particularly when automated assembly is employed, it is necessary to rapidly transfer large quantities of cap and tube assemblies to the filling machine. This is best accomplished by stacking a plurality of assemblies, with the assembled cap and tube being sized to fit inside other unfilled cap and tube assemblies. It is also necessary that these stacked assemblies be readily separable with a minimum amount of force, such as in a gravity feed so that the automated assembly equipment does not become jammed or otherwise malfunctioned. When this stacking feature is contemplated, it is necessary, of course, to size the cap portion so that it fits within the interior of the adjacent tube. Similarly, the cap cannot be so small that it fits into the nozzle. Accordingly, it object of this invention to provide a cap and tube assembly which is suitable for stacking.

When the junction between the tube and the discharge nozzle is a conventional junction, such as when the tube and nozzle are merely joined together, the ring or ridge which is formed at that junction has the potential for the cap becoming stuck in that junction, thereby causing a difficulty in the separation of two stacked assemblies. If the cap strikes the junction between the tube and a nozzle at an angle, there is the very real danger that the cap will become wedged in the orifice, thereby jamming or otherwise delaying the operation of assembly equipment.

SUMMARY OF THE INVENTION

It has now been discovered that the above and other objects of the present invention may be accomplished in the following manner. Specifically, a cap and tube assembly has been discovered which includes the following components.

First, there is a tube for containing a product. A nozzle is also included, having one end mounted to one end of the tube. The nozzle has at its other end a thin wall section which is puncturable to provide a discharge from the device. The nozzle has a smaller axial cross section than the tube. The junction of the tube and nozzle is constructed to define an inclined surface of transition from the larger cross section of the tube to the smaller cross section of the nozzle. The surface will resemble a funnel, having an axial cross section which begins with the larger cross section of the tube and decreases to the smaller cross section of the nozzle to form the inclined surface of transition. This surface of transition will permit flow of the contents without cavitation, even when the fluid is very non-viscous such as, for example, eye drops.

The cap and tube assembly of the present invention includes a cap which has an inside cross section which is sized to engage the nozzle. It also has an outside cross section which is less than the inside cross section of the tube, so that the tubes can be stacked on top of caps as will be described hereinafter.

The cap has an axially centered puncture means which is positioned in a first position spaced from the thin wall of the nozzle and is movable to a second position to puncture the thin wall and provide access to the contents therein. The puncture means is preferably one which includes a chisel shaped edged for forming a hole in the wall without fragmenting the thin wall of the nozzle.

In another embodiment of the present invention, there is provided a means positioned in the tube for preventing entry of the cap into the nozzle when a plurality of assemblies are stacked on one another. This means is preferably located near the junction between the tube and the nozzle. It may comprise a plurality of stacking ribs attached to the inclined surface of transition, to prevent the cap from engaging the nozzle.

BRIEF DESCRIPTION OF THE DRAWINGS

These and other objects of the present invention and the various features and details of the operation and construction thereof are hereinafter more fully set forth with reference to the accompanying drawings, where:

FIG. 1 is a perspective view of a tubular plastic medicament container having a cylindrical closure member with an internal axially aligned piercing member, shown as having an open terminal end prior to filling with a medicament, all in accordance with the invention.

FIG. 2 is an enlarged, exploded sectional elevational view of the assembly shown in FIG. 1.

FIG. 3 is a sectional view taken along the line 3,3 of FIG. 2, showing additional details of the piercing point.

FIG. 4 is a plan view of the container taken along line 4,4 of the FIG. 2, showing additional details of the discharge port and diaphragm.

FIG. 5 is a section view, taken along line 5,5 of FIG. 2 showing additional details of the three triangular shaped stacking ribs.

FIG. 10 is perspective view of the medicament assembly shown in FIGS. 1–9, after being filled with medicament and having its lower terminal end flattened and heat sealed.

DETAILED DESCRIPTION OF THE PREFERRED EMBODIMENT

Figures 6, 7, 8, 9:
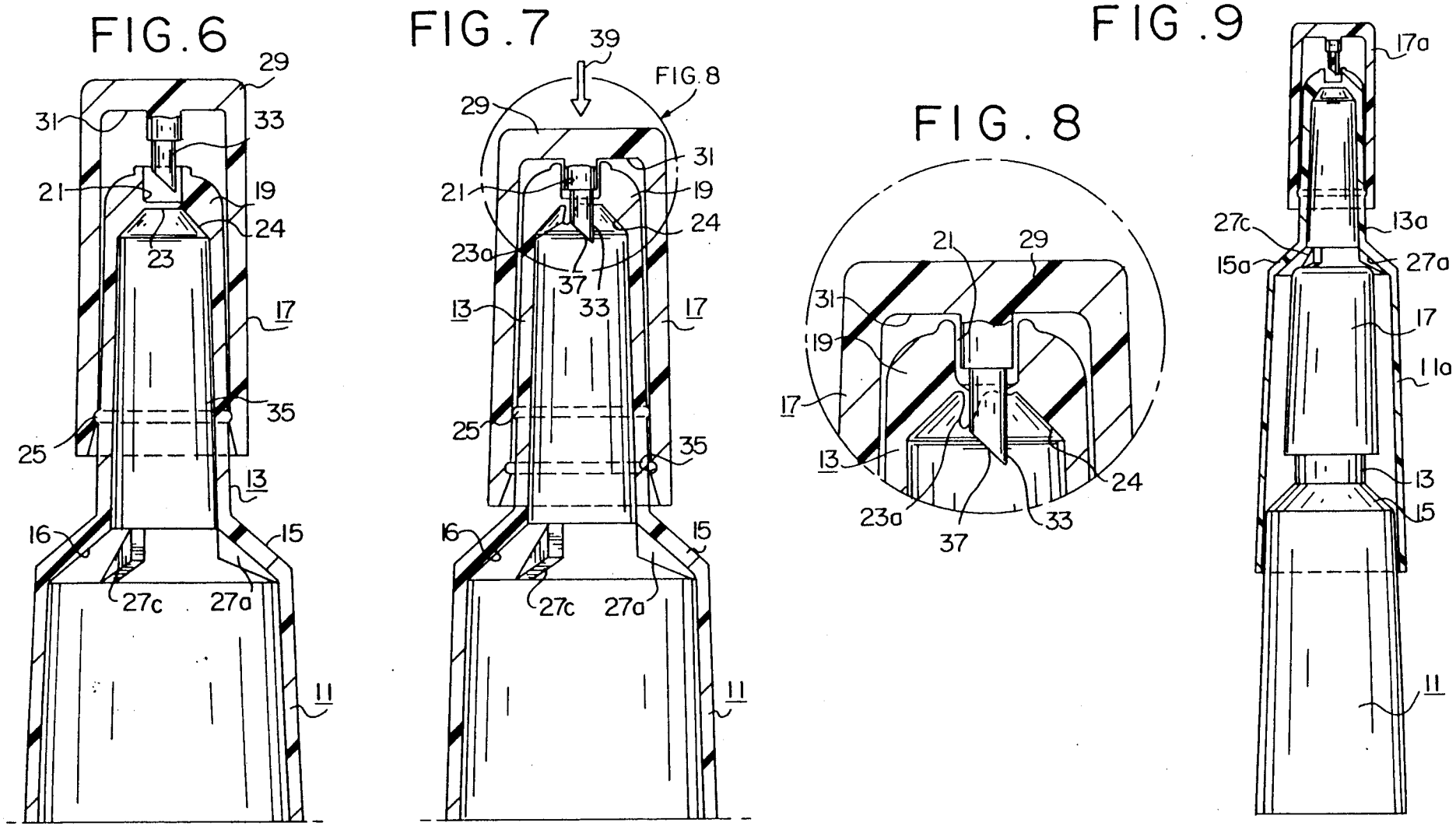
FIG. 6 is an enlarged fragmentary sectional elevational view taken along lines 6,6 of FIG. 1, showing details of the assembled medicament container and cylindrical member, in an interlock storage mode.
FIG. 7 ,is a view similar to FIG. 6, but showing the outer closure member moved forcefully downward, upon the neck portion of the medicant container, driving the piercing point through the diaphragm, creating an opening through which medicament may be dispensed.
FIG. 8 is a greatly enlarged view of the detail contained within the dot and dash circle of FIG. 7, and designated FIG. 8, showing the piercing having cut through the diaphragm but due to the design of the point creating a flap which is retained by the container neck.
FIG. 9 shows the unfilled medicament assemblies in a stacked, non-jamming mode.

The device of this invention shown generally by the reference numeral 10 includes a tube portion 11 which has a nozzle 13 at one end thereof, which is joined to the tube via a junction 15. Fitted on the nozzle 13 is a cap 17.

Shown in greater detail in FIG. 2 is the tube 11 and nozzle 13. The nozzle 13 has an axial cross section which is smaller than the axial cross section of the tube 11 such that the junction 15 of the nozzle 13 and the tube 11 defines an inclined surface of transition 16 which permits flow of product from the tube 11 to the nozzle 13 without cavitation or other turbulence.

The other end 19 of nozzle 13 includes a recess 21 protecting a thin wall portion 23 which functions as a diaphragm. The thin wall 23 maintains the sterility and the integrity of the contents until the thin wall or diaphragm 23 is broken as will be described hereinafter. The inside wall 24 adjacent the diaphragm 23 is tapered to facilitate total discharge of the contents in the same way that surface of transition 16 functions.

Nozzle 13 also contains a rib 25 on the outside thereof for positioning the cap as will be described hereinafter. Also shown in FIG. 2 and in FIG. 5 is a stacking rib 27 which may be formed in three parts, shown as **27*a*, 27*b*, and 27*c*** respectively.

The cap 17 has a closed end 29 with an interior wall 31. Mounted on the interior wall 31 is a piercer point 33 which serves to puncture the diaphragm 23 when access to the contents is desired.

The cap 17 also includes a groove 35 located on the inside wall of the cap and sized to interlock with the ring 25 and provide a means for fixedly locating the cap 17 with respect to the tube 11. It is, of course, possible to reverse these two elements so that the ring or rib 25 would be on the inside of cap 17, and the groove 35 would be in the nozzle 13. The ring and groove serve as a surface of resistance and an interference surface which cooperate to restrain movement of the cap on the nozzle.

The surface of nozzle 13 is non-threaded and is slightly tapered, with its larger end near junction 15. Similarly, the cap 17 has a non-threaded cap surface which is tapered in the same way as nozzle 13. Thus, nozzle 13 and cap 17 have surfaces which meet to locate the cap end nozzle in a first position, such as shown in FIG. 6.

Finally, it is noted that the piercing point 33 preferably has a chisel shape in order to form a hole in the diaphragm 23 without fragmenting the thin wall 23.

As shown in FIG. 6, the cap 17 is located on the nozzle 13 by the interlocking of the rib 25 and the groove 35. When the cap 17 is fixed in this location, the piercing point 33 does not reach to the diaphragm 23, thereby preserving the integrity of the contents. In order to obtain access to the contents, pressure is applied to the cap 17 in the direction of arrow 39 so that the chiseled shape 37 of the piercer point 33 passes through the diaphragm 23 and causes a portion **23*a* to peel back and provide access to the contents when the cap 17** is removed.

If all of the contents tube 11 have not been removed, the cap 17 can be replaced such as by relocating the ring 25 and groove 35. In order to prevent the contents from escaping the tube altogether, the cap 17 can be repositioned as shown in FIGS. 7 and 8, so that the piercing point 33 serves as a plug for the hole created by peeled portion **23*a* of the diaphragm 23**.

Typically, however, the present design is most suitable for a unit dose application. For this reason, the junction 15 defines an inclined surface of transition 16 to permit flow of the contents without cavitation from the tube 11 to the nozzle 13. Inside wall 24 serves the same purpose. Once the contents have been expelled, the cap can be replaced on the nozzle, engaging ring 25 in groove 35 until the entire assembly can be disposed of properly.

During the assembly process, it may be desirable to stack a plurality of assemblies, particularly when there is automated equipment in use. Shown in FIG. 9 is a tube 11 and cap 17 positioned within the tube **11*a* of a second assembly. Note that the stacking ribs 27*a* and 27*c* prevent the cap 17 from entering the opening to nozzle 13*a*. The advantage of this construction is that the assemblies do not become stuck to one another when stacked and they can be easily removed for filling, labeling or other assembly operations. The depth of the ring 25 and groove 35 is sufficient to prevent movement of the cap 17 with respect to the nozzle 13** during this assembly process.

The final step in the assembly of the device of this invention is shown in FIG. 10, where the other end of tube 11 has been flattened and heat sealed at 41. Thus, the entire contents are protected and sterile conditions are preserved until the time when the medicament is needed.

While particular embodiments of the invention have been illustrated and described herein, it is not intended to limit the invention, and changes and modifications may be made herein within the scope of the following claims.

What is claimed is:

1. A cap and tube assembly device, comprising:

a tube for containing a product;

a nozzle having a one end mounted to one end of said tube and having a thin wall section puncturable to provide a discharge on the other end;

said nozzle having a non-threaded outer nozzle surface with a smaller axial cross section than said tube, the junction of said tube and said nozzle defining an inclined surface of transition to permit flow without cavitation from said tube to said nozzle;

a cap having an inside non-threaded cap surface with a cross section sized to slidably engage said nozzle and having an outside cross section less than the inside cross section of said tube;

said cap having an axially centered puncture means positioned in a first position spaced from said thin wall and movable to a second position to puncture said thin wall said nozzle surface and cap surface mating to locate said first position;

wherein the outside of said nozzle is provided with a surface of resistance and the inside of said cap has an interference surface, whereby said surface of resistance and said interference surface cooperate to selectively maintain said puncture means in said first position;

said puncture means having a chisel shaped edge for forming an axially centered hole in said wall without removing or fragmenting said wall; and means positioned in said tube including a plurality of stacking ribs attached to said inclined surface of transition for preventing entry of said cap into said nozzle when a plurality of said assemblies are stacked one on another.

2. The device of claim 1 wherein said surface of resistance and said interference surface comprise mutually aligned tapered surfaces on the outside of said nozzle and the inside of said cap to provide a snug fit at said first position, said cap being expandable upon movement to said second position.

3. The device of claim 1 wherein said surface of transition is at approximately 45° with respect to the axis of the nozzle and tube.

* * * * *